United States Patent [19]

Nakata et al.

[11] Patent Number: 4,736,838

[45] Date of Patent: Apr. 12, 1988

[54] WRITING INSTRUMENT CASE

[75] Inventors: Toshiaki Nakata; Katsuhiko Nakakuma, both of Tokyo, Japan

[73] Assignee: Plus Corporation, Tokyo, Japan

[21] Appl. No.: 852,775

[22] Filed: Apr. 16, 1986

[30] Foreign Application Priority Data

Jul. 12, 1985 [JP] Japan ..... 60-106806[U]
Nov. 1, 1985 [JP] Japan ..... 60-168996[U]

[51] Int. Cl.[4] ..... B65D 5/50

[52] U.S. Cl. ..... 206/45.18; 206/45.2; 206/443; 206/214

[58] Field of Search ..... 206/45.13, 45.18, 45.2, 206/45.22, 443, 214; 220/23.4

[56] References Cited

U.S. PATENT DOCUMENTS

D. 201,715 7/1965 Newlin, Jr. et al. .
D. 253,180 10/1979 Anderka .
804,725 11/1905 James ..... 206/45.2
1,130,811 3/1915 Goldsmith .
1,283,832 11/1918 McCarroll ..... 206/45.24
1,319,973 10/1919 Simpson ..... 206/45.2
1,379,240 5/1921 Bashwiner .
1,988,104 1/1935 Andrews .
2,412,938 12/1946 Amoth .
3,187,723 6/1965 Kihara .
3,317,081 5/1967 Cornelius ..... 220/23.4
3,428,380 2/1969 Danjczek .
3,602,371 8/1971 Weiner et al. ..... 206/45.24
3,647,105 3/1972 Keeslar ..... 220/23.4
4,210,239 7/1980 Takahashi .
4,562,923 1/1986 Katada et al. .

FOREIGN PATENT DOCUMENTS 2154431 5/1973 Fed. Rep. of Germany .

*Primary Examiner*—Joseph Man-Fu Moy
*Attorney, Agent, or Firm*—McAulay, Fields, Fisher, Goldstein & Nissen

[57] ABSTRACT

A writing instrument case includes a case body, a lid frame releasably attached to the case body, an edge member provided at an opening of the casy body such as to engage with the lid frame, the edge member having a row of through-holes through which writing instruments may be inserted one by one, a retainer plate made of flexible material and provided between the edge member and the case body, the retainer plate having retaining holes aligned with the through-holes, each of the retaining holes having an inner pheriphery on which protrusions are appropriately provided. The case body has a recessed edge on the upper portion of its periphery surface, while the lid frame has a protruding member engaging with the recessed edge.

3 Claims, 5 Drawing Sheets

WRITING INSTRUMENT CASE

BACKGROUND OF THE INVENTION

1. Field of the Invention

The present invention relates to a writing instrument case suitable for use in arranging and keeping writing instruments such as fountain pens and mechanical pencils.

2. Description of the Prior Art

When contained in various types of cases made of cloth or synthetic resin and transported, writing instruments held within a case collide with each other if they are not held in place by clips provided therewith, and the shock created by such collision may cause the lead of mechanical pencils to be broken and the caps of fountain pens to be displaced, even if the fountain pens are themselves held by clips, and this may lead to the pen tip being damaged.

Therefore, it is necessary to provide a member capable of retaining the accommodated writing instruments individually. While it is possible to form such a retainer if cloth or leather is employed as a case material, it is difficult to make one properly if the material to be used is of a rigid type such as synthetic resin. A case made of flexible material such as cloth or leather cannot be adapted to be free standing, and can be used only for carrying writing instruments. Such a case has no ornamental value when used on a desk.

What is called a pencil stand has thus typically been employed when wishing to store and arrange writing instruments on a desk. Such a pencil stand is generally made in the form of a cylinder, and has a circular or square cross-section and an opening at its upper end. It is not therefore appropriate to use it as a portable means for carrying writing instruments in view of its shape and size.

SUMMARY OF THE INVENTION

Accordingly, it is an object of the present invention to provide a writing instrument case which is capable of firmly retaining writing instruments on an individual basis so that breaking of lead and displacement of caps can be prevented, and which can be placed in a free standing state on a desk such as to be used as a pencil stand.

To this end, according to the present invention, there is provided a writing instrument case including a case body, a lid frame releasably attached to the case body, an edge member provided at an opening of the case body such as to engage with the lid frame, the edge member having a row of through-holes through which writing instruments are inserted one by one, a retainer plate made of flexible material such as synthetic resin and provided between the edge member and the case body, the retainer plate having retaining holes aligned with the through-holes, each of the retaining holes having protrusions appropriately provided on its inner periphery such as to prevent the writing instruments from colliding with each other during the carriage, the case body having a recessed edge on the upper portion of its peripheral surface, and the lid frame having a protruding member engaging with the recessed edge when the case body is supported by the lid frame and is placed in a free standing state on a desk such as to be used as a pencil stand.

BRIEF DESCRIPTION OF THE DRAWINGS

In the accompanying drawings which show an embodiment of a writing instrument case according to the present invention.

DESCRIPTION OF THE PREFERRED EMBODIMENT

Figure 1:
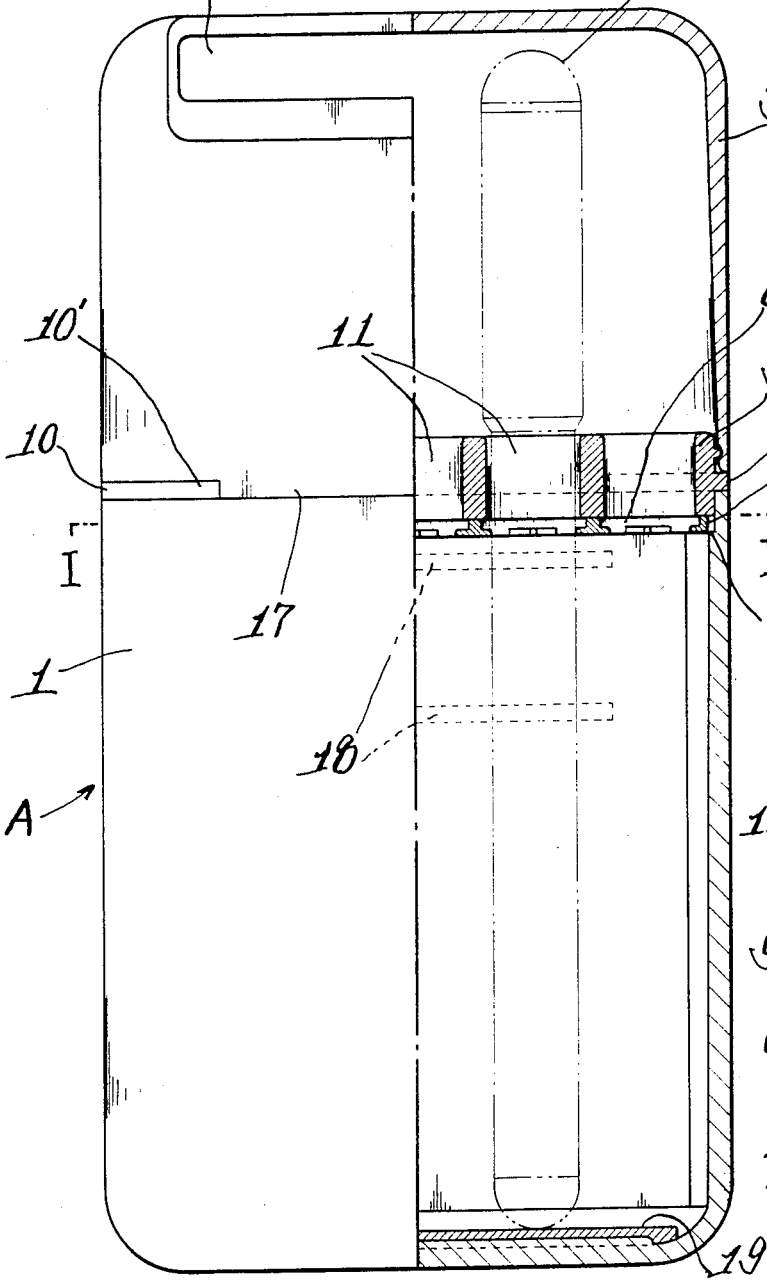
FIG. 1 is a partially broken away front elevational view.
Figure 2:
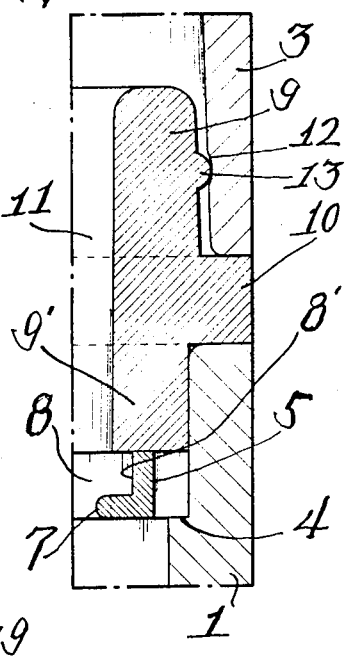
FIG. 2 is an enlarged view of part of FIG. 1.
Figure 3:
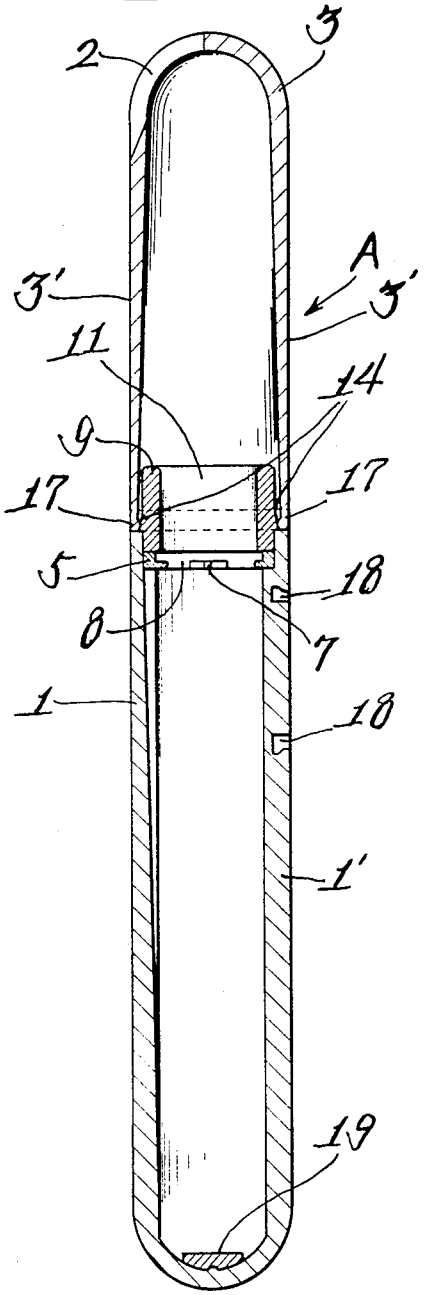
FIG. 3 is a longitudinal side elevational view.

A writing instrument case A according to the present invention has a case body 1 and a lid frame 3 having a window 2 at its upper edge through which writing intruments W accommodated in the case A are made visible.

The case body 1 made of rigid synthetic resin is cylindrical in shape, and has an upper open end and a closed bottom. A shoulder 4 is formed on the inner side of the upper open end. A retainer plate 5 made of flexible synthetic resin is engageably mounted on the case body 1 in such a manner that it is received by the shoulder 4. The retainer plate 5 is provided with retaining holes 8 aligned with each other in a row. Each retaining hole 8 has projections 7 disposed around its inner periphery 8' at equal intervals.

The retainer plate 5 is supported by an edge member 9 disposed thereon and the shoulder 4 when engaged with the case body 1 as described above. The edge member 9 has a collar on its peripheral surface, and is secured by engaging the lower portion thereof with the case body 1 in such a manner that the collar 10 and the lower end 9' are placed on the upper end of the case body 1 and the retainer plate 5, respectively. The edge member 9 is provided with a row of holes 11 for inserting the writing instruments W which correspond to the retaining holes 8 provided in the retainer plate 5. The edge member 9 is also provided above the collar 10 protruding on its peripheral surface with protrusion 13 adapted to engage with locking-groove 12 provided on the lid frame 2.

A reference numeral 14 is an engaging portion provided by cutting out opposing straight edge portions 10' of the same width from the collar 10 and having a tapering edge 15 at its lower end. Protruding members 17 are provided on opposing side plates 3' of the lid frame 3 at its lower central portion and are adapted to engage with the engaging portions 14. Each of the protruding members 17 has a protruding edge or bead 16 on its inner surface which is adpated to be pressed against the tapering edge 15. Recessed edges 18 provided in two strips and having the same width as that of the protruding members 17 are provided on the upper portion of one side surface 1' of the case body 1, these recessed edges 18 being spaced apart from each other in the vertical direction.

In addition, a cushion 19 made of sponge is placed at the bottom of the case body 1.

With the above-described arrangement of the writing instrument case of the present invention, when the writing instrument W is inserted through the through-hole 11 and the retaining hole 8, the body of the writing instrument is supported by the projections 7 provided on the inner periphery of the retaining hole 8, and is thereby held in place. This means that the case is ready to be carried once the lid frame 3 is engaged with the case body 1.

Figure 4:
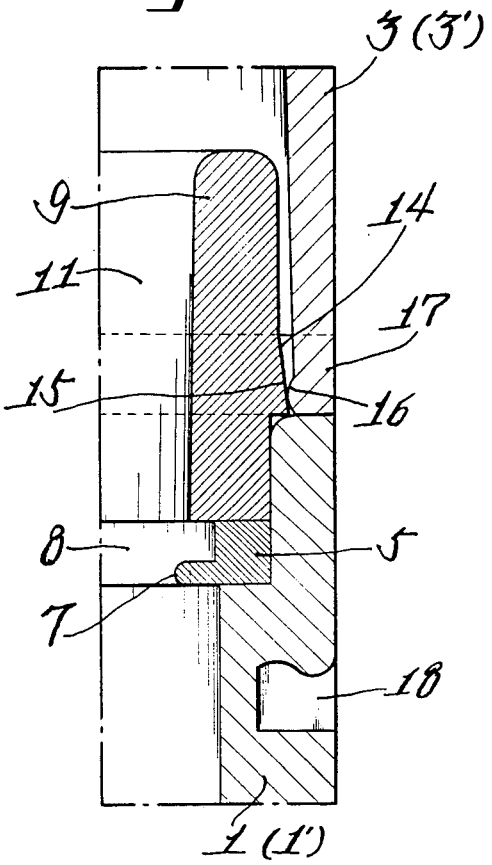
FIG. 4 is an enlarged view of part of FIG. 3.
Figure 6:
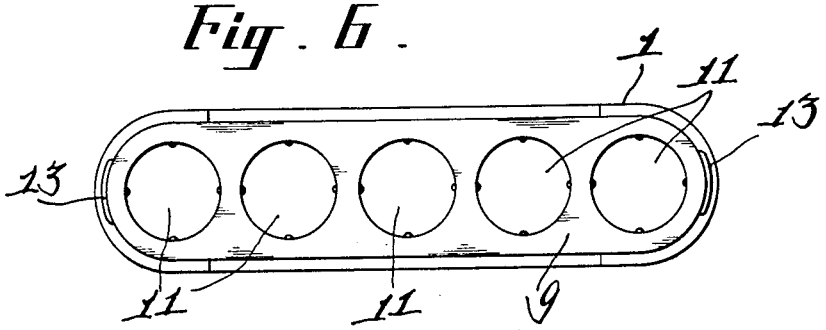
FIG. 6 is a plan view of a case body.
Figure 5:
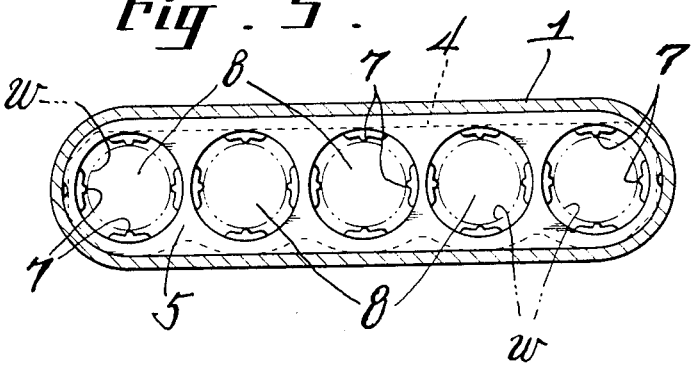
FIG. 5 is a cross-sectional view taken along the line I—I' of FIG. 1.
Figure 7:
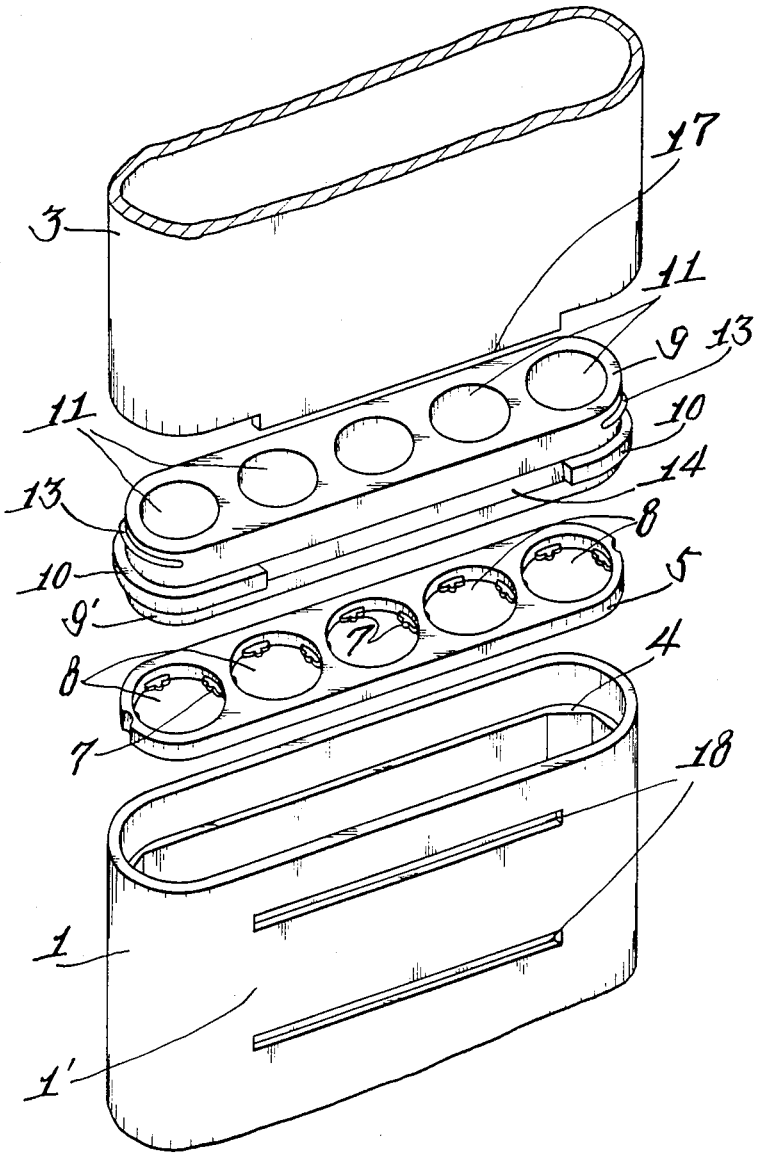
FIG. 7 is a perspective view.
Figure 8:
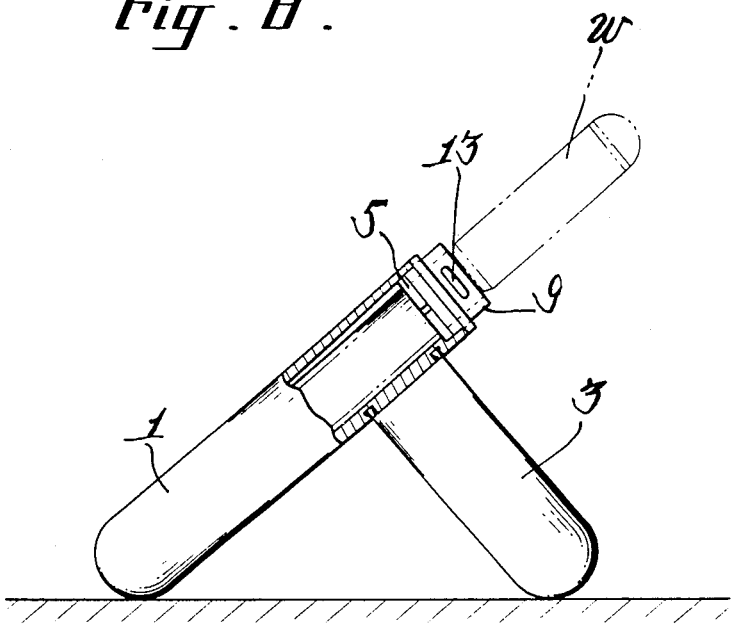
FIG. 8 is a partially broken away side elevational view, showing an example of how the case is used on a desk.

The case is made suitable for use on a desk, as shown in FIG. 8, by removing the lid frame 3 the case body 1 and inserting the protruding members 17 provided on the lid frame 3 into the recessed edges 18 provided on the upper portion of the case body 1. As shown in FIG. 4, the wall defining the recessed edge 18 is curved at 18A to define a narrow mouth so that the protruding members 17 or beads 16 are firmly retained in the recesses 18 behind the narrow mouth portion to maintain the lid in place.

What is claimed is:

1. A case comprising an open case body having side walls and a lid frame having side walls mountable on said case body for closing said case body, inwardly directed beads in facing relationship to each other on the inner surfaces of said walls of said lid frame adjacent the lower edge thereof, a member received in said case body extending upwardly beyond the open end of said case body for supporting items placed in said case body, said member having outwardly tapering walls spaced inwardly of the outer surface of said case body to provide a seat for the lower edge of said lid frame side walls, and positioned to engage said bead when said lid frame is on said case body with said lower edges of said lid frame side walls engaging said seat in a press fit to retain said lid frame on said case body, and vertically spaced slots provided on a side wall of said case body for receiving the beaded portion of said lid frame side walls therein, said slots having a narrow mouth portion to retain said bead within said slot, whereby said lid frame functions as a support for said case body.

2. A case as in claim 1, in which said slots are substantially horizontal, and said bead is positioned on said lid frame to orient said lid frame perpendicularly to the side surface of said case body so that said lid frame provides a support for said case body when siad case body is oriented at an angle to a supporting surface.

3. A case as in claim 1, and a bevelled edge at the top of said lid frame engageable with a support surface when said beads are received in said slot, whereby said lid frame provides a stable support.

* * * * *